US009725146B2

(12) United States Patent
Jensen

(10) Patent No.: US 9,725,146 B2
(45) Date of Patent: Aug. 8, 2017

(54) PROPULSION MECHANISM

(71) Applicant: Seafut ApS, Svendborg (DK)

(72) Inventor: Henning Jensen, Svendborg (DK)

(73) Assignee: SEAFUT APS, Svendborg (DK)

( * ) Notice: Subject to any disclaimer, the term of this patent is extended or adjusted under 35 U.S.C. 154(b) by 327 days.

(21) Appl. No.: 14/402,618

(22) PCT Filed: May 21, 2013

(86) PCT No.: PCT/EP2013/060396
§ 371 (c)(1),
(2) Date: Nov. 20, 2014

(87) PCT Pub. No.: WO2013/174804
PCT Pub. Date: Nov. 28, 2013

(65) Prior Publication Data

US 2015/0132146 A1 May 14, 2015

(30) Foreign Application Priority Data

May 21, 2012 (DK) ..... 2012 70269

(51) Int. Cl.
*B63H 5/02* (2006.01)
*B63H 1/04* (2006.01)

(52) U.S. Cl.
CPC ..... *B63H 5/02* (2013.01); *B63H 1/04* (2013.01)

(58) Field of Classification Search
CPC ... B63H 1/00; B63H 1/02; B63H 1/04; B63H 5/02
USPC ..... 416/90 A; 440/90, 91, 92
See application file for complete search history.

(56) References Cited

U.S. PATENT DOCUMENTS

| | | | | |
|---|---|---|---|---|
| 128,069 | A * | 6/1872 | Roberts | F04D 29/703 416/247 R |
| 317,488 | A * | 5/1885 | Barth | F04D 1/006 415/99 |
| 1,360,182 | A * | 11/1920 | Cortes | B63H 1/04 244/70 |
| 1,390,523 | A * | 9/1921 | Fortier | B63H 1/04 416/119 |
| 3,387,580 | A | 6/1968 | Walker | |
| 4,171,675 | A | 10/1979 | Thompson | |
| 4,832,642 | A | 5/1989 | Thompson | |
| 5,213,528 | A | 5/1993 | Seiford, Sr. | |
| 7,090,553 | B1 | 8/2006 | Seiford, Sr. | |

* cited by examiner

*Primary Examiner* — Richard Edgar
(74) *Attorney, Agent, or Firm* — Knobbe Martens Olson & Bear LLP

(57) ABSTRACT

A propulsion mechanism (100) for a maritime vessel (200) including a rotor (75) mounted for rotation about a rotor axis. The rotor (75) includes a plurality of vanes (20) extending essentially radial to the rotor axis and the vanes are arranged to define spaces (25) in between the vanes (20). The propulsion mechanism (100) further includes means configured for freeing the spaces (25) of water by means of application of air.

17 Claims, 4 Drawing Sheets

PROPULSION MECHANISM

CROSS-REFERENCE TO RELATED APPLICATIONS

This application is the U.S. National Phase under 35 U.S.C. §371 of International Application PCT/EP2013/060396, filed May 21, 2013, which claims priority to Danish Patent Application No. PA2012 70269, filed May 21, 2012. The disclosures of the above-described applications are hereby incorporated by reference in their entirety.

The present invention relates to a mechanism for propelling maritime vessels such as ships, boats incl. pleasure boats, barges and the like.

According to one aspect, the present invention relates to a propulsion mechanism for a maritime vessel such as a ship or a barge or equivalent.

The propulsion mechanism includes a rotor comprising a rotor axle carrying a plurality of vanes. The vanes define spaces in-between them. The propulsion mechanism further includes a screen configured to shroud a portion of the rotor.

It is understood that the expressions ship, boat or vessel, throughout this specification, are meant to denote any kind of mechanically powered floating surface structure suitable for carrying either persons, cargo or a combination thereof.

BACKGROUND

Propulsion of ships and the like by means of rotors comprising radial vanes, where the rotors are oriented transverse to a longitudinal axis of the ship, has long been a recognized way of applying propulsive power to water.

In the last century or so, it has become common practise to propel ships and the like by means of one or more propellers rotating about an axis of rotation co oriented with a longitudinal axis of the ship. The one or more propellers typically are driven by power plants burning fuel oil.

Power plants of ships are assigned to comply with various regulations limiting the power plants levels of emissions.

Recent tightening of the regulations relating to ships' levels of emission in coastal regions has forced ship owners and operators to seek alternative ways of powering their ships as levels of emission, when operating on heavy fuel oil, exceed the permissible levels as set forth by the regulations.

One widely applied solution has been to operate the ships, in coastal regions, on more environmental friendly oils such as light gas oil; however, with the latest tightening of the regulations, even when operating on light gas oil, the levels of emission violates the regulations.

Owners and operators therefore are looking for alternative ways of propelling their ships, particular in coastal regions.

BACKGROUND ART

U.S. Pat. No. 4,171,675 A discloses a propulsion mechanism comprising a radial vane rotor mounted for rotation about a horizontal axis extending athwart ships of a boat. A rotor housing encircles the major portion of the rotor and has an axial inlet and a downwardly directed peripheral outlet. The tips of the rotor vanes project through the housing below the surface of the water surrounding the boat. When the boat is travelling at low speed, the rotor functions as the impeller of a centrifugal pump, i.e. drawing water into the housing through the axial inlet, and discharging the water through the peripheral outlet to propel the boat. The outlet can be shifted circumferentially fore and aft to alter the direction of water discharged. At high speed, planning of the boat elevates the housing so that only air is drawn through its axial inlet and discharged through its peripheral outlet, i.e. the majority of boat-propelling force being produced by the paddle wheel action of the rotor vane tips.

U.S. 2006/189227 A discloses a paddle wheel propulsion system. The system includes a paddle wheel mounted for rotation about a horizontal axis for propelling a vessel. Further, the paddle wheel propulsion system is configured for rotation about a vertical axis, perpendicular to its horizontal axis, for steering the vessel. The paddle wheel is supported for limited vertical movement relative to the vessel. Reversible power means is provided for independently controlling movement of the paddle wheel about its vertical and horizontal axis and for elevating and lowering the paddle wheel. According to the disclosure, the efficiency of the system may be improved by the provision of concave paddles.

GB 1159010 A discloses a submersible craft having a lightweight plastic hull. The craft is propelled by a pedal driven rotor arranged to rotate in a cavity in the plastic hull. According to the disclosure, an air pocket may be established in the cavity in order to free an upper half of the rotor from water. According to the authors of GB 1159010 A, the speed of which the rotor rotates is so low that the air bubble in the cavity will remain essentially constant.

BRIEF DESCRIPTION OF THE INVENTION

It is an object of the present invention to set forth a propulsion mechanism configured for propelling a maritime vessel such as a ship and the like by means of one or more rotors comprising radial vanes. The one or more rotors may be oriented horizontal or vertical and transverse to a longitudinal axis of the ship.

The propulsion mechanism according to the present invention is configured in a way leading to improved efficiency and flexibility.

Up to this day, prior art has failed to teach a simple and yet reliable and inexpensive propulsive mechanism which in a safe and reliable manner, without substantially increasing the weight and/or particulars of the propulsive mechanism, improve the efficiency of today's propulsive mechanisms comprising radial vane rotors.

According to the invention, there is provided a propulsive mechanism as per the introductory part of this specification wherein the propulsion mechanism further includes means configured for freeing the spaces in-between the vanes of water by means of application of air such that an axial flow of water and/or air in the spaces is established along the rotor axle.

The freeing of water, or the evacuation of water, may be performed continuously during rotation of the rotor. The evacuation takes place while the spaces defined by the vanes and the screen shrouding a portion of the vanes are in their non water engaging position, i.e. while the spaces face the interior of the maritime vessel. This allows, in accordance with an aspect of the present invention, for improved efficiency as the spaces defined by the vanes are, when the vanes engage the water, able to take up, or engage, the water more effectively.

The freeing of water may be effectuated by axial "flushing" the spaces by applying air, or pressurized air, via axial inlets and/or outlets.

In some embodiments, the inlets and/or outlets may be radial.

The inlets and/or outlets may be provided with coupling means.

As an equal alternative, the air, or the pressurized air, may be applied via axial inlets and evacuation may be obtained via peripheral openings arranged in a peripheral screen shrouding a portion of the rotor facing the maritime vessel.

As a further and equal alternative, the freeing of water may be effectuated by applying the air or pressurized air to peripheral openings arranged in a peripheral screen shrouding a portion of the rotor facing the maritime vessel and evacuation may be obtained via axial outlets.

As a further and equal alternative, the freeing of water may be effectuated by applying the air or pressurized air to a central portion of the peripheral screen shrouding a portion of the rotor facing the maritime vessel and evacuation may be obtained via axial outlets.

According to one embodiment, the propulsion mechanism of the present invention further may include compressor or fan means configured for establishing pressurized air required for evacuating the spaces.

According to one embodiment, the propulsion mechanism further may include a disc-shaped rotor carrier. The rotor carrier may be configured for maintaining the rotor such that the vanes at least partially extend through an opening provided in the rotor carrier. The opening in the disc-shaped may be rectangular and the opening may be disposed essentially in the centre of the rotor carrier. Alternatively, the opening may be displaced from the centre of the rotor carrier.

The rotor carrier may be provided with means allowing the rotor carrier incl. rotor to pivot or rotate with respect to the site of installation in order to control the course, or turn, the maritime vessel.

According to one embodiment, the propulsion system further may include bearing means interposed between the propulsion mechanism, via the rotor carrier, and a bottom of a maritime vessel. The bearing means may be configured for allowing the propulsion mechanism to assume various orientations with respect to the bottom of the maritime vessel.

According to one embodiment, the means configured for freeing the spaces inter alia defined by the vanes of water by means of application of air is configured for applying air through an and face of the rotor or the rotor housing.

According to one embodiment, the means configured for freeing the spaces inter alia defined by the vanes of water by means of application of air may be configured for freeing the spaces of water by leading the water and/or air away from the spaces through one or more openings is the screen.

According to one embodiment, the water and/or air may be conveyed to one or more openings provided in the rotor carrier. The openings may be provided in the rotor carrier downstream the rotor when the maritime vessel is making way in a forward direction.

According to one embodiment, the means configured for freeing the spaces inter alia defined by the vanes of water by means of application of air is configured for applying air through an and face of the rotor or rotor housing and evacuating the spaces through an opposed end face of the rotor or rotor housing.

According to one embodiment, the mechanism and/or the rotor carrier may be configured such that the downwardly directed rotor vanes may extend below the lowermost portion of the hull of a maritime vessel. In embodiments configured for installation in ship's sides, the mechanism and/or the rotor carrier may be configured such that the vanes may extend a certain distance from the ship's side.

According to one embodiment, the axial flow of water and/or air may be evacuated from the spaces via an axial end of the rotor. The evacuation may take place from axial end of the rotor via outlet openings provided in the screen.

According to one embodiment, the mechanism further may include one or more a motors configured for driving and/or rotating the rotor and/or the rotor carrier.

According to one embodiment, the screen may be configured to shroud a portion of the rotor facing the interior of a maritime vessel when the propulsion mechanism is arranged in a maritime vessel. The screen further may be configured for shrouding the end faces of the rotor lying inside and/or outside the maritime vessel when arranged in a maritime vessel.

According to one embodiment, the diameter of the rotor axle, or the vane carrier, may be at least 5% a swept outer rotor diameter of the rotor. The effect of this is increased efficiency of the propulsion mechanism. According to other embodiments, the diameter of the rotor axle or vane carrier may be 10, 15, 20, 25 or 35% of the swept outer diameter of the rotor. The swept diameter of the rotor is defined by a theoretical circle bordering the outer edges of the vanes.

According to one embodiment, the vanes may extend essentially radial from an axis of rotation of the rotor axle.

According to one embodiment, the means configured for freeing the spaces of water and/or air by means of application of air may be configured for applying air through openings provided in the screen.

According to one embodiment, the means configured for freeing the spaces of water and/or air by means of application of air may be configured for applying air through an end face of the rotor.

According to one embodiment, the means configured for freeing the spaces of water and/or air by means of application of air may be configured for applying air through an end face of the rotor and evacuating the spaces through an opposed end face of the rotor.

According to one embodiment, the rotor axle carrying the plurality of vanes may be at least partially conical. The effect of this is to facilitate evacuation of the spaces.

According to one embodiment, the rotor axle may have its largest diameter in a central portion such that the diameter of the rotor axle decreases towards the ends of the rotor. In this embodiment, the rotor axle may be shaped as two opposed cones abutting each other with their large portions in the central part of the rotor.

According to one embodiment, the rotor axle may have its largest diameter in a central portion of the rotor and the means configured for freeing the spaces in-between the vanes of water by means of application of air may apply air through the screen against the area of the largest diameter of the rotor axle. This will establish two opposed axial flows of water and/or air in spaces. The water and/or air escape, in this embodiment, the spaces through both ends of the rotor through axial outlets arranged in the screen.

According to one embodiment, the rotor may be configured for rotation about a generally horizontal rotor axis when the propulsion mechanism is arranged in a maritime vessel.

According to one embodiment, the propulsion mechanism further may include a disc-shaped rotor carrier. The rotor carrier may be configured for maintaining the rotor incl. screen and any motor etc. such that the vanes at least partially extend through an opening provided in the rotor carrier. The rotor carrier may be configured to be interconnected with the hull of a ship.

According to one embodiment, the disc shaped rotor carrier may be configured to allow the propulsion mechanism to assume various orientations with respect to a bottom of a maritime vessel or with respect to a longitudinal axis of a maritime vessel.

According to one embodiment, the mechanism may be configured for installation with an essentially vertical axis of rotation of said rotor. Such embodiment may be preferred in case the propulsion mechanism is to be installed in a ship's side or equivalent.

According to another aspect of the present invention, a maritime vessel including one or more propulsion mechanisms according to the present invention is provided.

According to yet another aspect of the present invention, a method of propelling a maritime vessel including one or more propulsion mechanisms according to the present invention is provided.

DETAILED DESCRIPTION WITH REFERENCE TO THE FIGURES

The present invention may be applied to maritime vessels such as ships or barges etc. The invention may be applied as a primary or as a secondary propulsion mechanism. Further, the invention may be applied in sets comprising more than one propulsion mechanism.

In large oceangoing ships provided with a large heavy fuel consuming primary propulsion mechanism, the present invention may be incorporated as a supplementary propulsion mechanism in order to allow the ship owner or operator to shut down the ships primary power plant and propel the ship via one or more mechanisms according to the present invention. This way of operating maritime vessel may be preferred in regions wherein emission requirements are particularly strict.

The mechanism may be provided with not shown electric or hydraulic motors. In case the mechanism is driven by electric motors, the source of power could constitute one or more batteries allowing for emission less propulsion which may be preferred e.g. in coastal regions.

Figure 4:
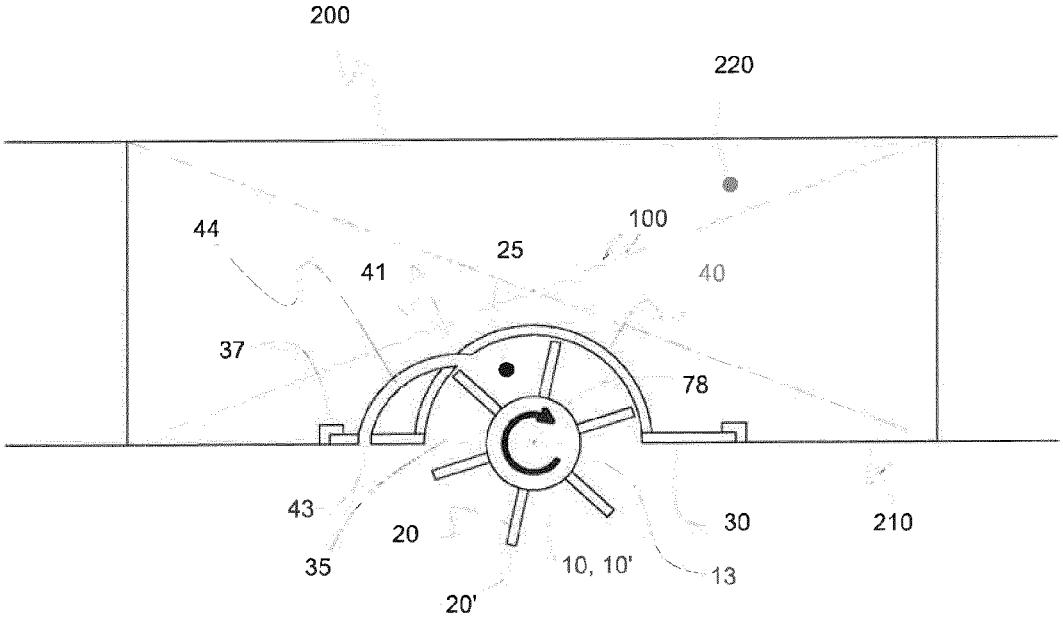
FIG. 4 is a principal and sectional view through a ship provided with a propulsion mechanism according to an embodiment of the present invention.
Figure 5:
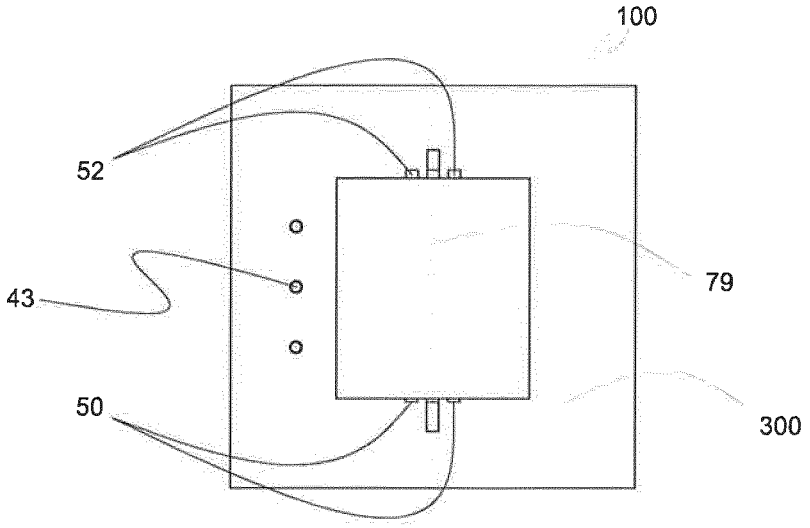
FIG. 5 is a top view of the propulsion mechanism according to an embodiment of the present invention.
Figure 6:
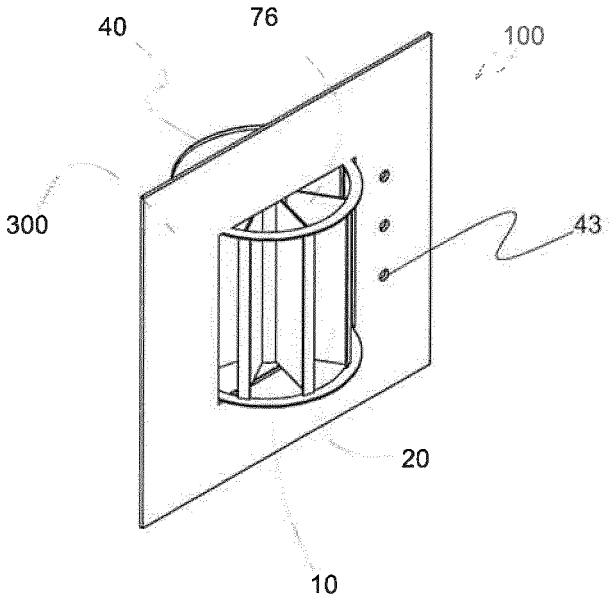
FIG. 6 is a perspective view of the propulsion mechanism according to an embodiment of the present invention.
Figure 7:
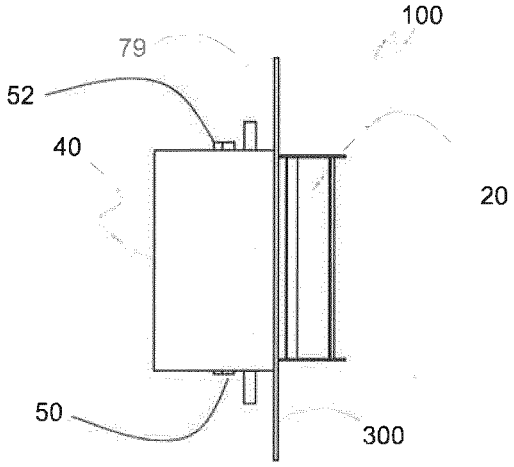
FIG. 7 is a side view of the propulsion mechanism according to an embodiment of the present invention.
Figure 8:
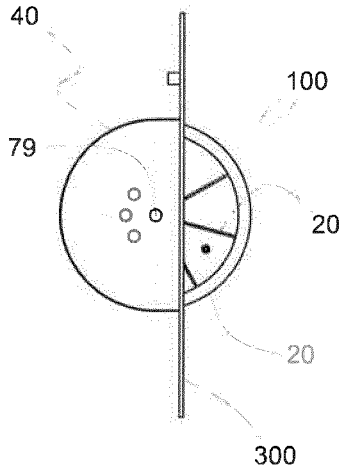
FIG. 8 is a side view of the propulsion mechanism according to an embodiment of the present invention.

As can be seen in the figures the mechanism according to the present invention constitutes a relatively small component which without undue burden may be installed, either under new building or as a retrofit, in the bottom of a ship such as shown in FIG. 4 where the mechanism is installed in double bottom tank 220.

FIGS. 5-8 show a propulsion mechanism according to an aspect of the present invention where the mechanism is configured for installation with an essentially vertical axis of rotation 79. This allows for installation of the mechanism in a ship's side.

The vanes 20 are, throughout the figures, shown as straight vanes extending radial from the centre of the rotor. This is not in any way limiting the scope of the present invention. The vanes may equally, even though not shown in the figures, be embodied as curved or V-shaped vanes 20 and the vanes 20 may or may not be arranged on the rotor axle 10, which may constitute the vane carrier, as extending radial from the rotor, i.e. the vanes may be arranged as inclined vanes opposed to the shown vanes.

Figure 1:
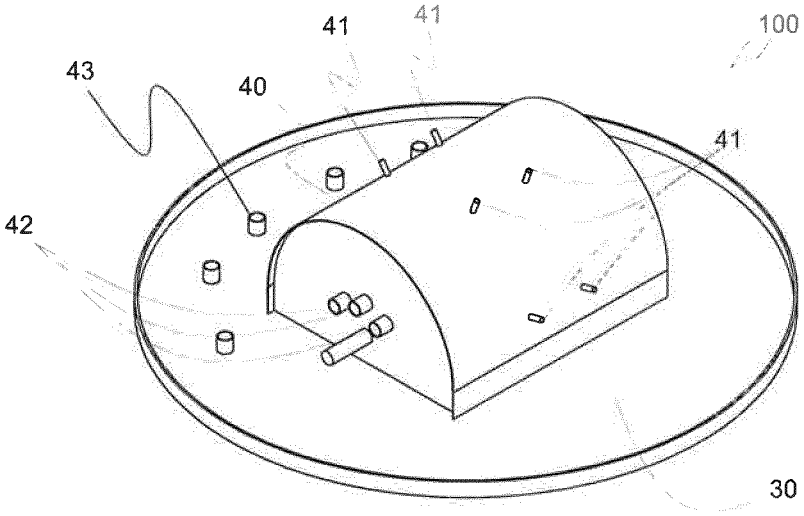
FIG. 1 is a perspective view of the propulsion mechanism according to an embodiment of the present invention.
Figure 2:
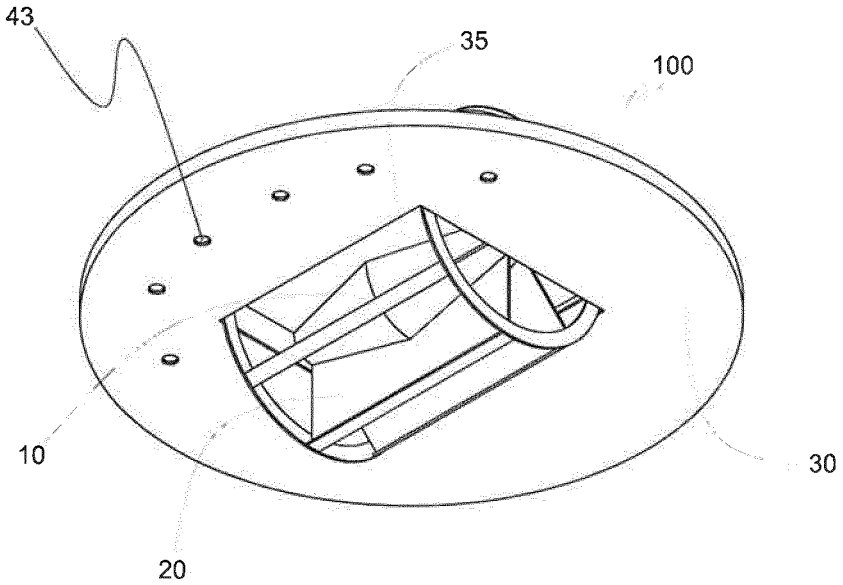
FIG. 2 is another perspective view of a propulsion mechanism according to an embodiment of the present invention.
Figure 3:
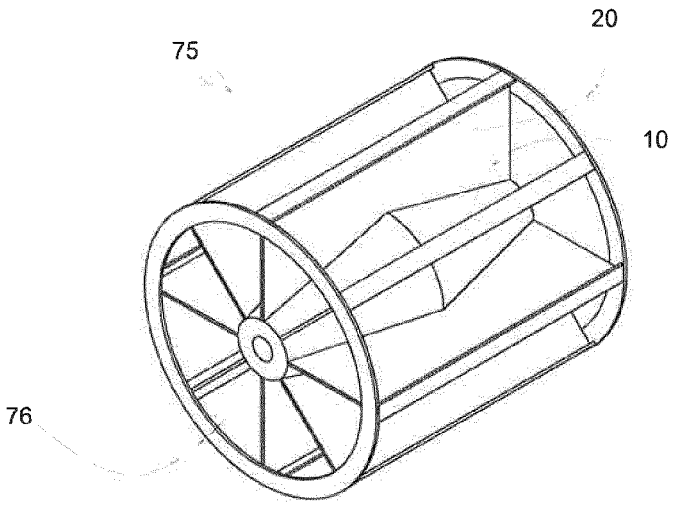
FIG. 3 is a perspective view of a rotor according to an embodiment of the present invention.

As can be seen in the figures, the vanes 20 may via their outer periphery define a cylindrical cylinder. As can be seen in FIGS. 2 and 3, the vanes 20 even define, via their outer periphery, the cylindrical cylinder in embodiments wherein the rotor axle 10, or vane carrier, is not cylindrical.

It is considered that decreasing the diameter of the rotor axle 10, or the vane carrier, towards the outlets facilitates evacuation of the spaces 25.

In embodiments wherein the mechanism is configured to be installed with an essentially vertical axis of rotation 79, such as shown in FIGS. 5-8, and where the air inlet 50 faces downwards and the outlet faces upwards, the rotor axle 10, or the vane carrier, will have its largest diameter in its lowermost end.

The rotor carrier 30 may be provided with secondary outlets 43 configured to convey evacuated water from the spaces 25 via the outlets 42, 52, out downstream the flow caused by rotation of the rotor 75. The secondary outlets 43 may be connected by conduits, as schematically indicated by pos. 44 in FIG. 4, to the outlets 42 and 52.

The application and combination of features and solutions presented by the present invention is not limited to the presented embodiments. One or more features of one embodiment can and may be combined with one or more features of other embodiments, whereby not described but valid, embodiments of the present invention may be obtained.

The term "comprises/comprising/comprised of" when used in this specification incl. claims is taken to specify the presence of stated features, integers, steps or components but does not preclude the presence or addition of one or more other features, integers, steps, components or groups thereof.

What is claimed is:

1. A propulsion mechanism for a maritime vessel, said propulsion mechanism comprising:

a rotor comprising a rotor axle carrying a plurality of vanes defining spaces in-between them, a screen configured to shroud a portion of said rotor, and means configured for freeing said spaces in-between said vanes of water by means of application of air such that an axial flow of water and/or air in said spaces is established along said rotor axle, wherein said rotor axle has its largest diameter in a central portion of said rotor and wherein said means configured for freeing said spaces in-between said vanes of water by means of application of air applies air through said screen against said largest diameter of said rotor axle such that two opposed axial flows of water and/or air in said spaces are established and wherein said water and/or air escapes said spaces through both ends of said rotor through axial outlets arranged in said screen.

2. The propulsion mechanism according to claim 1, wherein said axial flow of water and/or air is evacuated from said spaces via an axial end of said rotor.

3. The propulsion mechanism according to claim 1, wherein said mechanism further includes a motor configured for driving said rotor.

4. The propulsion mechanism according to claim 1, wherein said screen is configured to shroud a portion of said rotor facing the interior of a maritime vessel when said propulsion mechanism is arranged in a maritime vessel.

5. The propulsion mechanism according to claim 1, wherein a diameter of said rotor axle is at least 5% of a swept rotor diameter of said rotor.

6. The propulsion mechanism according to claim 1, wherein said vanes extend essentially radial from an axis of rotation of said rotor axle.

7. The propulsion mechanism according to claim 1, wherein said means configured for freeing said spaces of water by means of application of air is configured for applying air through openings in said screen.

8. The propulsion mechanism according to claim 1, wherein said means configured for freeing said spaces of water and/or air by means of application of air is configured for applying air through an end face of said rotor.

9. The propulsion mechanism according to claim 1, wherein said means configured for freeing said spaces of water by means of application of air is configured for applying air through an and face of said rotor and evacuating said spaces through an opposed end face of said rotor.

10. The propulsion mechanism according to claim 1, wherein said rotor axle carrying a plurality of vanes is at least partially conical.

11. The propulsion mechanism according to claim 1, wherein said rotor axle has its largest diameter in a central portion and wherein its diameter decreases towards the ends of the rotor.

12. The propulsion mechanism according to claim 1, wherein said rotor is configured for rotation about a generally horizontal rotor axis when said propulsion mechanism is arranged in a maritime vessel.

13. The propulsion mechanism according to claim 1, wherein, wherein said propulsion mechanism further includes a disc-shaped rotor carrier, said rotor carrier is configured for maintaining said rotor such that said vanes at least partially extend through an opening provided in said rotor carrier.

14. The propulsion mechanism according to claim 13, wherein said disc shaped rotor carrier is configured to allow said propulsion mechanism to assume various orientations with respect to a bottom of a maritime vessel.

15. The propulsion mechanism according to claim 1, wherein said mechanism is configured for installation with an essentially vertical axis of rotation of said rotor.

16. The propulsion mechanism according to claim 1, wherein said mechanism is configured for installation in or on a ship's side.

17. A propulsion mechanism for a maritime vessel, said propulsion mechanism comprising:

a rotor comprising a rotor axle carrying a plurality of vanes defining spaces in-between them, a screen configured to shroud a portion of said rotor, and means configured for freeing said spaces in-between said vanes of water by means of application of air such that an axial flow of water and/or air in said spaces is established along said rotor axle, wherein said rotor axle is conical and has its largest diameter in a portion extending downwards when said mechanism is installed in a ship's side and wherein said means configured for freeing said spaces in-between said vanes of water by means of application of air applies air through said lowermost end of said rotor, through axial inlets, such that an ascending axial flow of water and/or air in said spaces is established and wherein said water and/or air escapes said spaces through axial outlets.

* * * * *